US005516313A

United States Patent [19]

Lumpkin

[11] Patent Number: 5,516,313

[45] Date of Patent: May 14, 1996

[54] FIRE FIGHTING ACCESSORY FOR JET PROPULSION SYSTEM

[76] Inventor: Anthony P. Lumpkin, 105 Yorkshire, Rainbow City, Ala. 35906

[21] Appl. No.: 401,095

[22] Filed: Mar. 8, 1995

[51] Int. Cl.[6] ..... B63H 11/00

[52] U.S. Cl. ..... 440/39; 440/38

[58] Field of Search ..... 169/62, 70; 40/38, 40/39, 900; 60/221, 222

[56] References Cited

U.S. PATENT DOCUMENTS

| | | | |
|---|---|---|---|
| 1,677,769 | 7/1928 | Hayden | 440/39 |
| 1,943,152 | 1/1934 | Weiss | 440/39 |
| 3,112,707 | 12/1963 | Keck | 440/900 |
| 3,139,060 | 6/1964 | Dane | 440/39 |
| 3,233,573 | 2/1966 | Hamilton | 440/39 |
| 3,339,516 | 9/1967 | Lenci | 440/39 |
| 3,613,630 | 10/1971 | Jacuzzi | 440/39 |
| 3,941,076 | 3/1976 | Rice | 440/39 |
| 4,699,596 | 10/1987 | Klinker et al. | 440/39 |
| 4,699,597 | 10/1987 | Oja | 440/66 |
| 4,832,632 | 5/1989 | Rogozienski | 440/39 |
| 5,064,392 | 11/1991 | Wonders | 440/39 |
| 5,150,663 | 9/1992 | Kobayashi | 116/209 |
| 5,299,960 | 4/1994 | Day et al. | 440/39 |

*Primary Examiner*—Edwin L. Swinehart

*Attorney, Agent, or Firm*—Robert C. Curfiss; Butler & Binion

[57] ABSTRACT

A fire fighting accessory for diverting the water flow generated by a jet propulsion system from the drive unit to a fire fighting implement, the accessory specifically designed to be attached to an existing drive system in a noninterfering relationship with the steering nozzle of the jet. The accessory may be mounted either downstream or upstream of the jet outlet and is controllable from within the vessel. In one embodiment, the accessory coupler is moved into and out of engagement with the drive unit. In an alternative embodiment, a valve system is used to direct water into either the jet outlet or the accessory coupler.

6 Claims, 3 Drawing Sheets

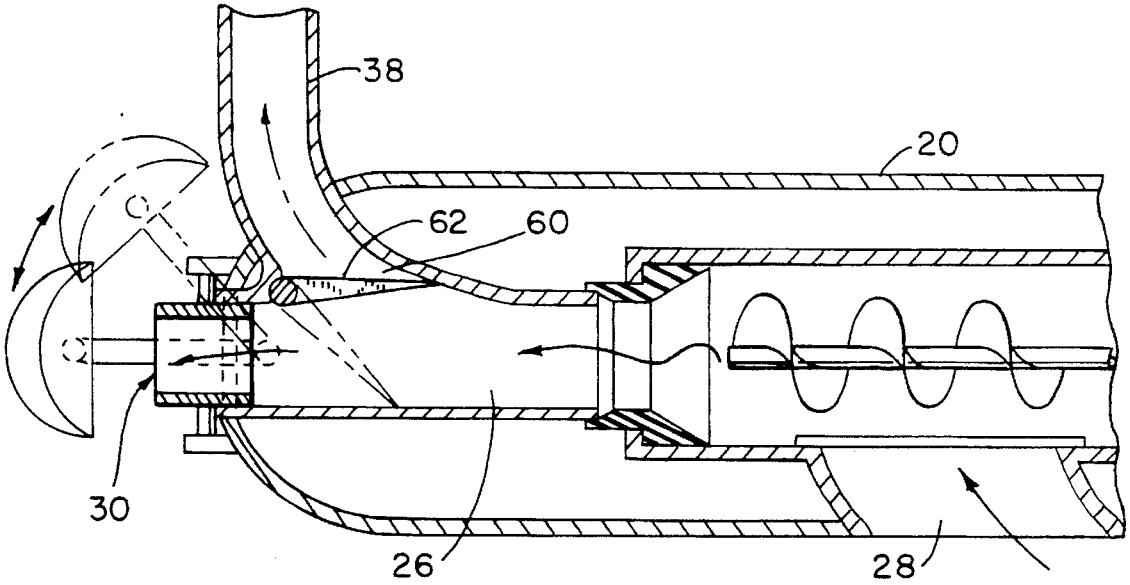
FIG. 3
FIG. 4
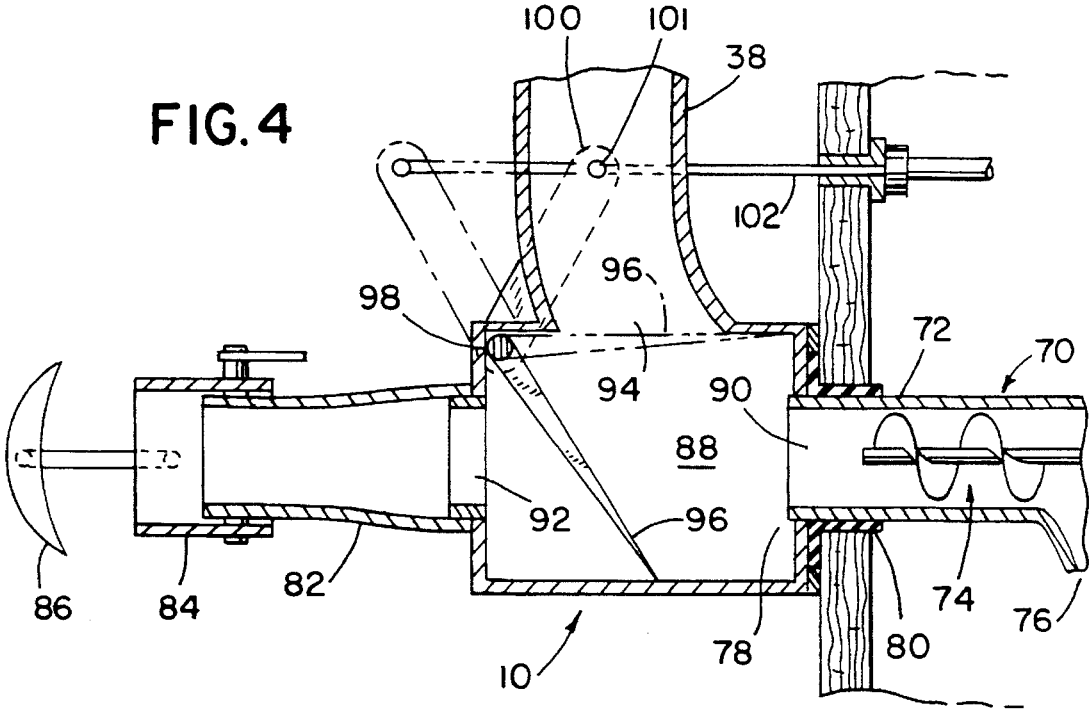

FIRE FIGHTING ACCESSORY FOR JET PROPULSION SYSTEM

BACKGROUND OF THE INVENTION

FIELD OF THE INVENTION

This invention is generally related to fire fighting apparatus and is specifically directed to an accessory for converting a jet propulsion system to a fire fighting water pump on a floating vessel for supplying pressurized water from the lake or sea.

DISCUSSION OF THE PRIOR ART

It is well known to use floating vessels in fire fighting procedures where the fire is on a floating platform, boat or the like or where the fire is near the shore or bank of a body of water, making accessibility by water desirable. One of the distinct advantages of use of floating vessels is the ability to pump water directly from the body of water onto the fire to assist in bringing the fire under control. In order for this action to be effective, it is generally necessary that a single pump is capable of delivering approximately 1500 gallons of water per minute.

Over the years, a number of successful pumps have been developed for this purpose. Typically, such pumps are mounted directly on vessel and are designed to draw water directly from the sea, lake or river and dispense it through a remote nozzle for application to the fire. An early example of a fire fighting boat is shown and described in U.S. Pat. No. 1,677,769, entitled: "FIRE-FIGHTING BOAT", issued to H. Haden on Jul. 17, 1928. As there shown, the pump is used to both apply water to the fire and alternatively to provide a propulsion force for the boat. As an early attempt to combine water delivery and propulsion systems, this patent deals with some important issues of the time, recognizing that a high volume, low pressure system is used for propulsion, while a lower volume, high pressure system is desirable for fire-fighting. At the time of the Haden disclosure, fire-fighting boats were large harbor boats, weighing several tons and were not designed to operate at high speeds. Such boats could easily accommodate a plurality of pumps adapted to be connected either in series or in parallel, depending on whether configured for propulsion or for delivery of water on a fire.

More recently, jet propulsion systems have become available on light weight boats, particularly on speed boats and personal watercraft such as "Jet Skis" manufactured by Kawasaki, "WaveRunners" manufactured by Yamaha, and the like. However, while such boats would be desirable as fire fighting equipment because of their speed and maneuverability, effective fire fighting equipment has not been available. The cumbersome and complex system of the Haden patent is not adaptable for such use and is far to heavy for use in light weight craft.

A number of systems have been developed for high speed, light weight applications. For example, U.S. Pat. No. 4,699,597, entitled: "Pump Attachment for Outboard Motors", issued to R. Oja on Oct. 13, 1987, shows a shell for encapsulating the screw propeller of an outboard motor to create a pump chamber for pumping water through a hose and nozzle. The assembly must be completely removed from the motor in order to use the motor to propel the boat. A similar device is shown and described in U.S. Pat. No. 3,112,707, entitled: "Pump", issued to N. Keck on Dec. 3, 1963. U.S. Pat. No. 5,299,960, entitled: "Auxiliary Water Projector for Jet Propelled Watercraft", issued to J. Day on Apr. 5, 1994, is a concept patent showing a fire hose on a personal watercraft. The pump accessory of this patent is fitted to the existing jet pump of the watercraft in such a manner that it will impede the maneuverability and performance of the craft.

A number of complex valving systems are shown, for example, U.S. Pat. No. 3,139,060, entitled: "Mobile Spraying Unit", issued to W. Dane on Jun. 30, 1964; U.S. Pat. No. 3,339,516, entitled: "Jet Propelled Fire Fighting Boat", issued to V. Lenci on Sep. 5, 1967; and U.S. Pat. No. 3,613,630, entitled: "Marine Jet Pumpout and Fire-Fighting Equipment", issued to F. Jacuzzi on Oct. 19, 1965. While all of these devices attempt to use a single engine system to both propel the watercraft and provide a fire fighting water pump and nozzle, they each involve complex valving systems and cumbersome equipment. While these patents may have attempted to resolve maneuverability issues by placing the pump accessory system in advance of the boat steering system, this is accomplished with increased weight and cost.

There is no advantage in combining a propulsion system and a pump when the overall cost and weight of the watercraft approaches the cost and weight of a system using separate and independent pumps and propulsion systems. Therefore, unless the fire fighting accessory can be employed at a substantial cost savings over separate systems, and with a resulting reduction in weight, without impeding maneuverability of the watercraft, such systems are impractical.

At the same time, there remains a need for a highly maneuverable, low-cost watercraft for fighting the great majority of fires encountered by water rescue and fire fighting teams. Most fires do not require the large harbor boat of Haden, but require watercraft which are of high speed, maneuverable, and of relatively low costs. To date, such equipment is only available by outfitting small craft with separate fire fighting pumps.

Therefore, there remains a need for a fire fighting accessory for converting the propulsion system of small watercraft into a water pump for delivering water through a nozzle, without impeding the maneuverability of the craft when the pump is not in use.

SUMMARY OF THE INVENTION

The subject invention is directed to an accessory for converting the jet propulsion system of a light weight vessel into a pump for delivering water through a nozzle for fighting fires on the water or adjacent the shore or bank. The invention is specifically designed to be retrofitted on existing jet propulsion systems and is configured such that is does not impede the maneuverability of the craft when not in use as a pump.

In the preferred embodiment of the invention, the fire fighting accessory is adapted to be fitted directly on an outboard jet propulsion system such as, by way of example, jet propulsion outboard system manufactured by Jet Specialty Co. of San Leandro, Calif. and offered by Outboard Marine Corporation under the Johnson and Evinrude trademarks. In one configuration, the accessory is adapted to be placed directly on the existing jet port for diverting all of the water through a hose and to a remote fire fighting nozzle. When not in use as a pump, the accessory is completely removed from the port area, permitting the watercraft to be operated in the same manner as prior to addition of the accessory.

In an alternative application, the jet chamber is modified such that the accessory can be connected in parallel with the jet propulsion port, whereby all or any portion of the water stream may be diverted through the hose and the remote fire fighting nozzle. When not in use, all of the water is directed through the jet propulsion port and the craft operates in the same manner as prior to installation of the accessory. In this embodiment, the craft can be maneuvered while the pump is being used, greatly facilitating the flexibility of the fire fighting equipment.

It has also been found that each of these applications may be installed on "in board" jet systems with similar results.

It is therefore, an object and feature of the subject invention to provide a fire fighting accessory adapted to be retrofitted to an existing jet propulsion system of light weight watercraft without substantially adding to the weight of the vessel or impeding the maneuverability of the craft when not in use.

It is another object and feature to provide for a fire fighting accessory which is specifically adapted for use in connection with a jet propulsion system with the accessory positioned such that it does not interfere with the steering function of the propulsion jet.

It is an additional object and feature of the subject invention to provide a fire fighting accessory which permits maneuvering of the watercraft while diverting water through the fire fighting nozzle.

Other objects and features of the invention will be readily apparent from the accompanying drawings and detailed description of the preferred embodiments.

BRIEF DESCRIPTION OF THE DRAWINGS

FIG. 3 is a diagrammatic view of the system as shown in FIG. 2 in the forward operational mode.

FIG. 4 is a diagrammatic view of a modified system for use with an inboard type jet propulsion drive.

DETAILED DESCRIPTION OF THE PREFERRED EMBODIMENTS

Figure 1:
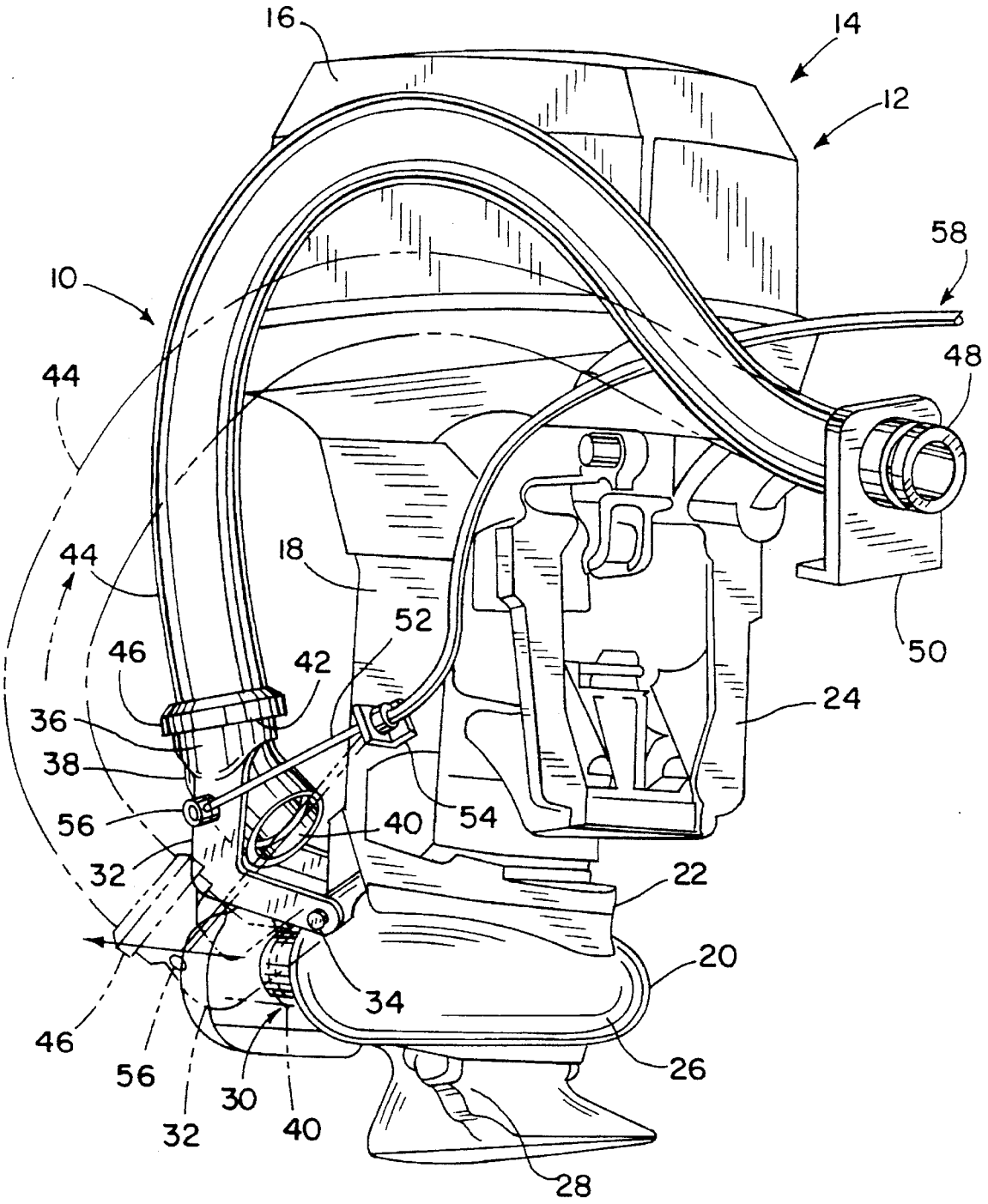
FIG. 1 a perspective view of one embodiment of the accessory of the subject invention, as attached behind the propulsion port of an outboard jet propulsion system.
Figure 2:
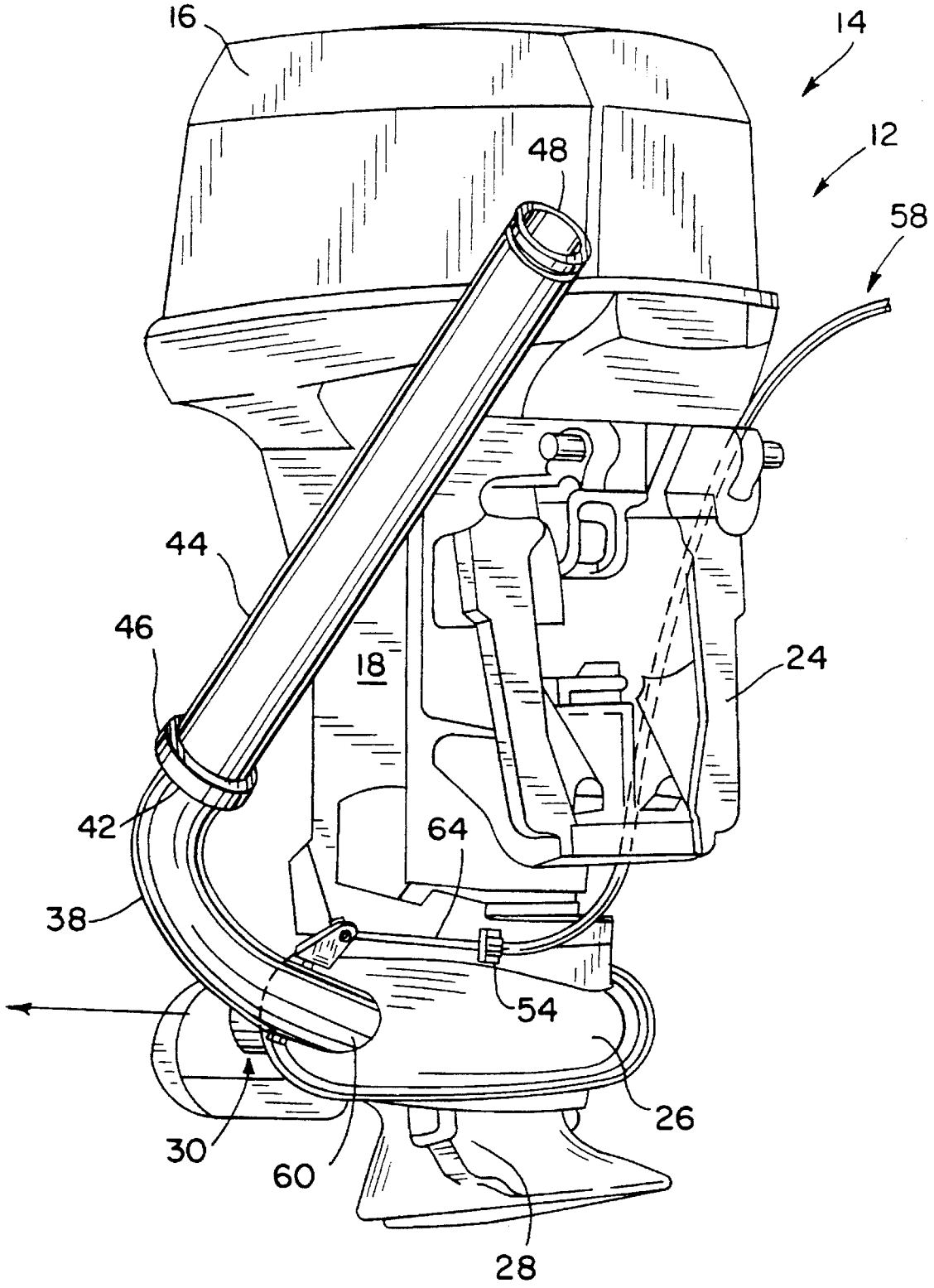
FIG. 2 is a perspective view of a second embodiment of the accessory of the subject invention, as attached in advance of the propulsion port of an outboard jet propulsion system.

A first embodiment of the accessory of the subject invention is shown in FIG. 1. As there shown, the fire fighting accessory 10 is mounted on a typical outboard type jet propulsion unit 12. In the drawings, the outboard unit is an OMC 90 horsepower motor with a jet propulsion drive. However, it will be readily understood that the accessory of the subject invention may be used in conjunction with any jet propulsion drive unit, with no modification to the unit as shown in FIG. 1, or with minimum modification to the unit as shown in FIGS. 2–4. As is typical, the jet propulsion drive 12 includes a head, enclosed by water resistant cowling 16. The 90 horsepower engine, not shown, is positioned in the cowling. A drive shaft, not shown, is housed in an upper unit 18, which also includes integral coolant water passages and exhaust passages. The lower drive unit 20 is mounted on the lower end 22 of the upper drive shaft unit 18. A clamp system 24 is provided for mounting the outboard unit to the transom of a typical small vessel.

Typically, the lower drive unit 20 of a jet propulsion drive includes an impeller or turbine, not shown, mounted in a closed chamber 26 and driven by the drive shaft extending from chamber 26 through housing 18 and into the head 16, where it is attached to the motor. A water intake port or scoop 28 is provided in advance of the impeller and a jet outlet port such as the steering nozzle 30 is provided downstream of the impeller. In operation, the motor turns the drive shaft and impeller, drawing water in through the scoop 28 and pushing it out through jet port 30, to provide thrust for propelling the vessel. In the preferred embodiment, the accessory of the subject invention is ideally suited for drive systems delivering a minimum of 1500 gallons per minute of water flow through the jet port.

As shown in FIG. 1, the first embodiment of the accessory 10 is attached directly to the standard outboard drive unit, behind the jet port 30. Specifically, a yoke type clamp 32 is secured by bolts 34, or the like directly to the lower unit 20. The bolts act as an axle, permitting the clamp 32 to rotate or pivot relative to the lower unit and the jet port. The upper end 36 of the clamp 32 is secured to a coupling 38. In the preferred embodiment, the coupling 38 is a rigid, formed tube having opposite open ends 40 and 42. The end 40 is shaped to conform to opening of the jet port 30. The opposite end 42 is adapted to be attached, in the well known manner, to a flexible conduit or hose 44 via coupler 46. The opposite end 48 of the hose 44 is adapted to be attached to a typical fire fighting implement such as a hose and nozzle assembly (not shown) or the like. In the embodiment of FIG. 1, a mounting bracket 50 is provided for securing the hose to the transom of the vessel. A control cable 52 is provided and is secured to the outboard unit at 54, with one end 56 attached directly to the clamp 32, and the other end 58 positioned in a suitable location in the vessel. When the vessel is in standard operation, the clamp 32 is positioned as shown and the jet port is unobstructed, permitting unimpeded operation of the vessel. When the fire fighting accessory is required, the control cable is engaged to pivot the clamp downward, bringing the end 40 of the coupling tube 38 into engagement with the mated jet port 30, directing all of the water into the hose 44 where it may be dispensed through end 40 and into the fire fighting implement.

A second embodiment of the invention is shown in FIG. 2, also attached to a typical jet propulsion outboard unit 12. In this embodiment, the chamber 26 has been modified to include a second outlet port 60 in parallel with the jet port 30. As better shown in FIG. 3, a butterfly or flap type valve 62 is positioned between the ports 30 and 60. A control cable 64 is attached to the valve, in typical fashion. When the valve 62 is in the normal closed position, closing the port 60, all of the water is directed through port 30, permitting the vessel to operated in the normal mode. When the valve is opened relative to port 60, it closes port 30 and directs all of the water through port 60 and via coupling 38 into hose 44 in the fire fighting mode.

An alternative embodiment of the invention is shown in FIG. 4, and is adapted for use with an inboard type drive unit 70. As there shown, the drive unit 70 drives a pump impeller in a drive tube 74 and downstream of a water intake scoop 76. In typical prior art installations, the outlet end 78 of the drive tube 72 extends through the transom area 80 of the hull of the vessel and is attached to a jet nozzle 82. A steering nozzle 84 is attached to the jet nozzle and may be pivoted about the axis 84 for steering the vessel as it is propelled through the water. Where desirable, a reverse thrust deflector 86 may be provided to permit operation of the vessel in the reverse direction. The accessory 10 of the subject invention is adapted to be positioned intermediately of the drive tube outlet 78 main nozzle 82, permitting attachment of the accessory without any interference with the control function of the drive and steering nozzles. In the preferred embodiment, the accessory 10 includes a control box or chamber 88 having opposite ports or openings 90 and 92. The inlet opening 90 is designed to mate with the outlet port 78 of the drive tube 74. The outlet opening 92 is configured for receiving and mounting the main nozzle assembly 82. A third, accessory outlet 94 is provided in parallel with the nozzle outlet 92. The coupling 38 for the fire fighting accessory is secured directly to the outlet 94. A flap type valve 96 is pivotally mounted in the control box 88 on an axle or axis 98 and is attached to a control lever 100. The control lever is coupled at 101 to a control cable or rod which terminates at a convenient location inside the vessel. When the flap valve 96 is in the upper most position it closes accessory port 94 and the vessel operates in the normal mode. When the control valve is in the lowermost position, it closes the jet port 92 and all of the water pumped through drive tube 74 is directed into the fire fighting accessory coupling 38. As can be seen from the drawing of FIG. 4, the entire assembly is attached outboard of the transom wall 80, permitting the accessory to be attached without modifying any of the drive system.

As can be seen from the foregoing the subject invention is particularly useful in modifying existing jet drive units to provide efficient, inexpensive fire fighting equipment. While certain embodiments and features of the invention have been described in detail herein, it will be readily understood that the invention encompasses all enhancements and modifications within the scope and spirit of the following claims.

What is claimed is:

1. A fire fighting accessory for directing water into a fire fighting implement, the accessory for use in combination with a jet propulsion drive unit for a floating vessel, the water jet propulsion drive unit including a steering nozzle for directing the vessel, the fire fighting accessory adapted to be connected to the drive unit in noninterfering relationship with the steering nozzle, the fire fighting accessory comprising:

a. a coupler adapted to receive water from the drive unit, the coupler including an inlet port adapted to be selectively placed in communication with the drive unit and an outlet port;

b. a flexible conduit having an inlet end in communication with the coupler outlet port and an outlet end adapted to be connected to the fire fighting implement; and c. diverting means comprising a movable valve located upstream of the steering nozzle for selectively diverting water from the steering nozzle to the coupler, and wherein the inlet of the coupler is positioned upstream of the steering nozzle, the movable valve adapted to be moved between a first position for completely closing the coupler inlet wherein all the water is directed through the steering nozzle and a second position for completely blocking the flow of water to the steering nozzle and diverting it into the coupler inlet.

2. The accessory of claim 1, wherein the valve is positioned in the drive unit.

3. The accessory of claim 1, wherein there is further included an auxiliary chamber adapted to be positioned between the drive unit and the steering nozzle, the chamber having an inlet in communication with the drive unit, a first, jet outlet in communication with the steering nozzle and a second, accessory outlet in communication with the coupler, and wherein the valve is positioned in the chamber and movable between a first, position for blocking and closing the accessory outlet while opening the jet outlet, and a second position for blocking and closing the jet outlet while opening the accessory outlet.

4. The accessory of claim 3, wherein the valve is a flap valve pivotally mounted in said chamber.

5. The accessory of claim 4, further including a control mechanism attached to the valve for controlling the position thereof.

6. The accessory of claim 5, the control mechanism further comprising a lever arm attached to the valve and a control line having one end attached to the lever and an opposite end positioned at a convenient location in the vessel.

* * * * *